United States Patent [19]

Vervloet et al.

[11] Patent Number: 4,808,509

[45] Date of Patent: Feb. 28, 1989

[54] DIFFUSION TRANSFER IMAGING METHOD AND RECEPTOR SHEET FOR MAKING PERSONAL IDENTIFICATION DOCUMENTS

[75] Inventors: Ludovicus H. Vervloet, Kessel; Willy P. De Smedt, Mechelen; Leon L. Vermeulen, Herenthout, all of Belgium

[73] Assignee: Agfa-Gevaert, N.V., Mortsel, Belgium

[21] Appl. No.: 95,402

[22] Filed: Sep. 11, 1987

[30] Foreign Application Priority Data

Sep. 23, 1986 [EP] European Pat. Off. ..... 86201640.9

[51] Int. Cl.[4] ..... G03C 5/54; G03C 5/04

[52] U.S. Cl. ..... 430/237; 430/10; 430/15; 430/207; 430/212; 430/227; 430/236; 430/244; 430/248

[58] Field of Search ..... 430/207, 212, 236, 237, 430/227, 244, 248, 10, 15, 206

[56] References Cited

U.S. PATENT DOCUMENTS 3,925,075 12/1975 Wingender et al. ..... 430/236

*Primary Examiner*—Richard L. Schilling

*Attorney, Agent, or Firm*—A. W. Breiner

[57] ABSTRACT

Method of making a personal identification document exhibiting textual data and a portrait of the person, characterized in that it comprises the steps of forming a monochrome photographic textual image in a monochrome photographic silver halide material, forming a color photographic portrait image in a color photographic silver halide material, producing from these images corresponding monochrome and colored diffusion transfer images in image-receiving layers on opposite sides of a common receptor sheet, said receptor sheet, which bears the resulting diffusion transfer images, constituting a said personal identification document. The invention also provides a receptor sheet for use in such method.

6 Claims, No Drawings

DIFFUSION TRANSFER IMAGING METHOD AND RECEPTOR SHEET FOR MAKING PERSONAL IDENTIFICATION DOCUMENTS

DESCRIPTION

The present invention relates to a method of making personal identification documents exhibiting textual data and a portrait. The invention also relates to a receptor sheet material for use in such method.

The increasing importance in our present-day societies of personal identification of holders of passports, licences, buyers' cards, membership cards, etc. is accompanied by the need to make identification documents as proof against forgery or counterfeiting as possible. Many identification documents display the name, personal data, and the signature of the bearer. For greater security, some identification documents include a portrait of the bearer. So far as the textual matter is concerned, it is usually written, printed, and/or typewritten in black-and-white, sometimes in colour. A portrait in colour is desirable, however, for easier and more reliable identification.

It is known to make personal identification documents in the form of a card bearing monochrome personal data on one side and a colour portrait on the other side. To make such an identification document, personal data such as the name, address, and the signature of the bearer have to be written, printed, and/or type-written on a sheet and in a distinct step a portrait of the bearer is affixed to said sheet.

An object of the present invention is to provide a more convenient method of producing identification documents.

According to the present invention, there is provided a method of making a personal identification document exhibiting textual data and a portrait of the person, characterised in that it comprises the steps of forming a monochrome photographic textual image in a monochrome photographic silver halide material, forming a colour photographic portrait image in a colour photographic silver halide material, producing from these images corresponding monochrome and coloured diffusion transfer images in image-receiving layers on opposite sides of a common receptor sheet, said receptor sheet bearing the resulting diffusion transfer images constituting a said personal identification document.

This method can be performed quickly and conveniently. Processing of each of the image-wise exposed light-sensitive materials to produce a corresponding diffusion transfer image can take place straight away after the image-wise exposure of such material and assembling of different prints back to back after their formation is not necessary.

The foregoing definition of the invention does not mean that the image-wise exposure of both the monochrome and colour photographic materials must take place before production of either of the corresponding diffusion transfer images in the receptor sheet. The image-wise exposure of either one of such materials and the development and diffusion transfer processing thereof to form the corresponding diffusion transfer image can be carried out before the other one of the photographic materials is image-wise exposed. However, as is hereafter more particularly described, it is preferable for the latent images to be formed in the photographic materials as preliminary steps so that the production of the diffusion transfer images can proceed at more or less the same time.

The invention includes a receptor sheet suitable for use in image-reception by diffusion transfer from image-wise exposed silver halide photographic materials, said receptor sheet comprising a layer-sustaining support made of a hydrophobic polymeric material or of paper coated with hydrophobic polymeric material, said supoort bearing on one side a non-light-sensitive image-receiving layer, which layer or another layer in water-permeable relationship therewith contains development nuclei for catalyzing the reduction of complexed silver halide on diffusion thereof into said layer, characterised in that said support bears on its other side a second non-light-sensitive layer into which second layer image-wise diffuson of dyes can take place from an image-wise exposed silver halide colour photographic material during contact of such material with the receptor sheet in the presence of an aquous alkaline processing solution, said second layer containing at least one mordanting agent capable of fixing said dyes.

The art of photographic diffusion transfer (DTR) image production is well known and needs no explanation. The principles of the DTR process as applied to silver salt diffuson from image-wise exposed monochrome photographic material are described e.g. in U.S. Pat. No. 2,352,014. More detail on such process can be found in "Photographic Silver Halide Diffusion Processes" by A. Rott and B. Weyde, Focal Press, London, N.Y. (1972) and the literature cited therein.

The production of coloured diffusion transfer images from image-wise exposed colour photographic materials comprising silver halide emulsion layers, which are sensitive to the blue, green, and red spectral regions and incorporate image dyes or dye-formers, depends on local modification of dye mobility in an alkaline liquid medium as a function of the amounts of silver halide that undergoes development. In commonly known dye diffusion transfer processes the dye-image-producing compounds are either initially mobile in alkaline aqueous media and become immobilized during processing, or are initially immobile and become mobilized during processing. A survey of such processes is given by Christian C. Van de Sande in Angew.Chem. - Int.Ed-.Engl. 22 (1983) no. 3, 191–209. More details on such processes and on dye-image-producing compounds can be found in the literature cited therein and in DE-A No. 1,095,115; 1,930,215; 1,772,929; 2,242 762; 2,505,248; 2 543,902; 2,645,656; and the Research Disclosures no. 15,157 (November 1976) and 15,654 (April 1977).

According to a preferred embodiment of the present invention the compositions of the different photographic silver halide materials are such that an aqueous alkaline processing liquid of the same composition is used for bringing about the development of both said materials and the diffusion transfer from both said materials. In the case an aqueous alkaline processing liquid of the same composition is in fact used for both development and diffusion transfer operations, a common supply of processing solution can be used for the formation of both transfer images. The fact that only one processing solution can be used for reproducing textual data on one side and a portrait of the person on the other side of a same receptor enhances the convenience of the imaging method of the present invention even more. When only one aqueous alkaline processing liquid is used for both development and diffusion transfer operations, the other ingredients needed for developing as well as effecting diffusion and image formation on both sides of the receptor sheet are comprised in the photographic silver halide materials and/or in the receptor sheet. According to this embodiment the developing agents needed for developing the different photographic silver halide materials have been incorporated preferably into said photographic silver halide materials e.g. in at least one silver halide emulsion layer thereof or in another layer in water-permeable relationship therewith.

According to another preferred embodiment of the present invention the two diffusion transfer operations are performed at substantially the same time. In this case the amount of aqueous alkaline solution needed to effect development and diffusion transfer to form the monochrome textual print and the amount of aqueous alkaline solution needed to effect development and diffusion transfer to form the colour portrait can be derived from the same container. However, to avoid that the process of development, diffusion transfer, and image formation on one side of the receptor sheet would interfere with the process taking place on the other side, it is advisable to apply the different volumes of the alkaline processing solution at separated processing stations. The apparatus described in the European Patent Application No. 85201679.9, which corresponds to the U.S. Ser. No. 916,176, now U.S. Pat, No. 4,708,450 can be used for moistening the photographic materials and the receptor sheet. Such apparatus comprises liquid applicator rollers that are arranged for wetting one side only of a sheet if the other side must not be affected.

For particulars about exposure and developing apparatus, which can be applied in the DTR-process, reference can be made to the above-mentioned book by A. Rott and E. Weyde, and to the literature cited therein.

The support of the receptor sheet should form an effective barrier between the non-light-sensitive image-receiving layer for receiving the textual data and the non-light-sensitive image-receiving layer for receiving the colour portrait, so that the specific chemistry of silver salt diffusion transfer cannot interfere with that of dye diffusion transfer and vice-versa. The support of the receptor sheet is a hydrophobic resin support or a resin-coated paper support. Examples of suitable hydrophobic resin film support materials are cellulose acetate, cellulose nitrate, polyvinyl acetal, polystyrene, polyethylene terephtalate, polycarbonate, polyvinyl chloride, etc., preferred resin film support materials being made of polyethylene terephtalate or of polyvinyl chloride. A preferred paper support is paper coated on both sides with an Alpha-olefin polymer e.g. polyethylene. The support should be opaque and, if it is not so by itself, it may comprise an opacifying agent or it can be coated with a stratum comprising an opacifyig agent. Suitable opacifying agents are e.g. titanium dioxide, zirconium oxide, zinc oxide, etc. The support usually has a thickness of approximately 0.05 to 0.50 mm.

The support can be provided with subbing layers on both sides to improve the adherence of the non-light-sensitive image-receiving layer for receiving the monochrome textual data and of the non-light-sensitive image-receiving layer for receiving the colour portrait. For the same purpose the support can be pre-treated on both sides with a corona discharge.

The non-light-sensitive image-receiving layer for receiving the monochrome textual data can be applied directly onto the support or onto subbing layers or other layers coated thereon beforehand.

The non-light-sensitive image-receiving layer for receiving the monochrome textual data may consist of or comprise any of the following binders: gelatin, albumin, casein, zein, polyvinyl alcohol, alginic acids or salts thereof, cellulose derivatives such as carboxymethyl cellulose, modified gelatin, etc. It is, of course, also possible to use mixtures of these binders. Preference is given, however, to gelatin.

The non-light-sensitive image-receiving layer for receiving the monochrome textual data, coated on one side of the receptor sheet according to the present invention or a layer adjacent to said image-receiving layer and in water-permeable relationship therewith comprises development nuclei, which promote the reduction of the diffusing silver complexes into metallic silver. Development nuclei have been described in the above-mentioned book by A. Rott and E. Weyde on pages 54–57. Suitable development nuclei are e.g. cobalt sulphide, zinc sulphide, nickel sulphide, silver nickel sulphide, etc.

The non-light-sensitive image-receiving layer for receiving the monochrome textual data or a layer adjacent thereto and in water-permeable relationship therewith may comprise a silver halide solvent e.g. sodium thiosulphate in an amount of approximately 0.1 g to approximately 4 g per m2.

The non-light-sensitive image-receiving layer for receiving the monochrome textual data or a layer adjacent thereto and in water-permeable relationship therewith may also comprise developing agents, hardeners, plasticizers, wetting agents, toning agents, optical brighteners, opacifying agents, substances improving the adherence to the underlying layer or the support, etc. For further information relevant to the composition of the image-receiving layer there can be referred again to the above-mentioned book by A. Rott and E. Weyde, pages 50–65.

The non-light-sensitive image-receiving layer for receiving a dye image can be applied directly onto the side of the support that is opposite to that, which is to carry the non-light-sensitive image-receiving layer for receiving the monochrome textual data, or it can be applied onto an adhesive layer or other layer coated thereon beforehand.

The non-light-sensitive image-receiving layer for receiving a dye image, which is coated on one side of the receptor sheet according to the present invention, or a layer adjacent to said non-light-sensitive image-receiving layer for receiving a dye image and in water-permeable relationship therewith comprises a mordanting agent. This mordanting agent can be any material, provided it performs the desired function of mordanting or otherwise fixing the diffused dyes. The selection of the particular material to be used is, of course, determined by the nature of the dye (s) to be mordanted. If acid dyes are to be mordanted, the non-light-sensitive image-receiving layer for receiving a dye image can be composed of or comprise basic polymeric mordants such as polymers of amino-guanidine derivatives of vinyl methyl ketone such as described in U.S. Pat. No. 2,882,156, and basic polymeric mordants and derivatives, e.g. poly-4-vinylpyridine, the metho-p-toluene sulphonate of 2-vinylpyridine and similar compounds described in U.S. Pat. No. 2,484,430, and the compounds described in DE-A No.2,200,063. Very interesting are the polymeric mordanting agents described in U.S. Pat. No. 4,186,014, such as e.g. the mordanting agent prepared from 4,4'-diphenylmethane diisocyanate and N-ethyldiethanolamine quaternized with epichlorohydrin. Suitable mordanting binders for use in the non-light-sensitive image-receiving layer for receiving a dye image are e.g. guanylhydrazone derivatives of acyl styrene polymers as described in e.g. DE-A No. 2,009,498. Effective mordanting compositions are long-chain quaternary ammonium or phosphonium compounds or ternary sulphonium compounds, e.g. those described in U.S. Pat. No. 3,271,147, and cetyltrimethyl-ammonium bromide and cetyltributyl-phosphonium iodide. Certain metal salts and their hydroxides that form sparingly soluble compounds with the acid dyes can also be used. The dye mordanting agents are dispersed in one of the usual hydrophilic binders for photographic layers e.g. in gelatin, polyvinyl pyrrolidone, or partly or completely hydrolysed cellulose esters. Preference is given, however, to gelatin.

Good results are obtained e.g. when the non-light-sensitive image-receiving layer for receiving a dye image, which layer is permeable to alkaline solution, has a thickness of approximately 0.2 to 10 μm. Of course, the thickness can be modified depending upon the results aimed at. The non-light-sensitive image-receiving layer for receiving a dye image can also contain other additives such as ultraviolet-absorbing substances to protect the mordanted dye images from fading, brightening agents e.g. stilbenes, coumarins, triazines, oxazoles, or dyè stabilizers such as the chromanols and alkylphenols.

Lowering of the pH-value after formation of the dye image in the non-light-sensitive image-receiving layer usually leads to increased stability of the transferred dye image. In general, the pH of the layer can within a short time after imbibition be lowered from about 14–13 to 11 but preferably to 7–5. For instance, polymeric acids as disclosed in U.S. Pat. No. 3,362,819 or solid acids or metal salts, e.g. zinc acetate, zinc sulphate, magnesium acetate, etc., as disclosed in U.S. Pat. No. 2,584,030, can be employed successfully for that purpose.

The acid for lowering the pH can be incorporated into a layer, which can be coated with an inert timing or spacer layer that times or controls the pH-reduction proportionally to the rate, at which alkali diffuses through this inert spacer layer. Examples of such timing layers include gelatin, polyvinyl alcohol, or any of the colloids disclosed in U.S. Pat. No. 3,455,686. The timing layer can be effective in evening out the reaction rates over a wide range of temperatures. For instance, premature pH-reduction is prevented, when imbibition is effected at temperatures above room temperature, e.g. at 35° to 37° C. The thickness of the timing layer is usually comprised between approximately 2.5 and 18 μm. Especially good results are obtained when the timing layer comprises a hydrolysable polymer or a mixture of such polymers, which are hydrolysed slowly by the processing liquid. Examples of such hydrolysable polymers are e.g. polyvinyl acetate, polyamides, or cellulose esters.

The non-light-sensitive image-receiving layer for receiving a dye image can be covered with a protective layer, preferably a gelatin protective layer.

The non-light-sensitive image-receiving layer for receiving a dye image may also comprise other ingredients such as e.g. plasticizers.

For further information relevant to the composition of the non-light-sensitive image-receiving layer for receiving a dye image there can be referred to the above-mentioned U.S. Pat. No. 4,186,014.

The alkaline processing solutions used in the making of the monochrome textual print and the colour portrait by DTR processing can be aqueous solutions of alkaline substances that are commonly used for DTR processes.

In the event that is is not desired to use an alkaline processing solution of the same composition for the formation of both diffusion transfer images, the solution for the silver complex diffusion transfer process for forming the monochrome image can comprise ingredients such as developing agents, a silver halide solvent, thickening agents, preserving agents, toning agents, fog-inhibiting agents etc. The different alkaline processing solution for the dye diffusion transfer imaging may then comprise ingredients such as developing agents, thickening agents, etc.

After formation of the monochrome textual print and the colour portrait on opposite sides of the receptor sheet, the monochrome photographic material and the colour photographic material are separated therefrom. The receptor sheet, when in dry condition, is then protected against damage, dirt, and forgery by laminating it on both sides with a plastic cover, more particularly a transparent hydrophobic resin cover, e.g. a polyethylene terephthalate resin sheet, by a technique known as heat-sealing. The hydrophobic resin cover can be made of the same material as that used for the support of the receptor sheet, though preferably it is a resin sheet coated with or consisting of a resin having a lower glass transition temperature (Tg) and melting temperature than those of the resin used for the support. According to a preferred embodiment the hydrophobic resin cover is a polyethylene terephthalate resin sheet coated with a resinous melt-adhesive layer, e.g. a polyalkylene layer, preferably polyethylene layer, having a glass transition temperature at least 40° C. lower than that of the resin used for the support. In this connection reference is made to the Tg values of polyethylene, polypropylene, polyvinyl chloride and polyethylene terephthalate being −20° C., +5° C., +80° C. and +67° C. respectively (see J.Chem. Educ., Vol. 61, No. 8. August 1984, p. 668).

The lamination of the receptor sheet carrying the monochrome textual print and the colour portrait with a hydrophobic resin cover can be performed in common laminating devices available on the market for heat-sealing lamination purposes.

In case the support of the receptor sheet is a polyvinyl chloride support, the hydrophobic resin cover used for laminating the receptor sheet carrying the monochrome textual print and the colour portrait is preferably a polyethylene terephthalate resin sheet coated with a polyalkylene layer, preferably a polyethylene layer, having a glass transition temperature at least 40° C. lower than that of the polyvinyl chloride, the lamination then being performed preferably by heat-sealing.

The following example illustrates the present invention.

EXAMPLE

A paper support coated on both sides with polyethylene and having a width of 24 cm and a thickness of 100 um was exposed on both sides to an electrical discharge produced by a corona-discharge apparatus operating under the following conditions:

travel speed film: 10 m/min,
electrode spacing to surface of the film: 2 mm,
corona current: 0.65 A,
AC-voltage difference (peak value): 10 kV.

frequency: 30 kHz.

One side of the corona-treated film was coated with the following composition at a ratio of 15 m2/l to form a non-light-sensitive image-receiving layer thereon for use according to the silver complex DTR-process:

| | |
|---|---|
| demineralized water | 750 ml |
| gelatin | 45 g |
| silver sulphide/nickel sulphide development nuclei | 7 g |
| saponin | 10 g |
| 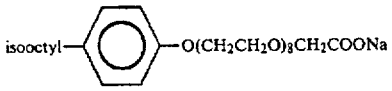 | 5 g |
| 20% aqueous formaldehyde | 8.5 ml |
| demineralized water to make | 1000 ml |

After drying of the resulting image-receiving layer the other side of the corona-treated film was coated with the following composition to form a non-light-sensitive image-receiving layer for receiving a dye image thereon (the quantities given refer to a coated surface of 1 m2):

gelatin: 2.5 g polymeric mordanting agent prepared from 4,4'-diphenylmethane diisocyanate and N-ethyldiethanolamine quaternized with epichlorohydrin as described in Example 1 of U.S. Pat. No. 4,186,014: 2.5 g While still wet the non-light-sensitive image-receiving layer for receiving a dye image was covered with a protective layer of gelatin (0.6 g/m2).

The resulting receptor sheet carrying an image-receiving layer for receiving a textual image on one side and an image-receiving layer for receiving a dye image on the opposite side was then allowed to dry.

A light-sensitive element capable of recording continuous tone or halftone data was then made as follows.

A gelatin silver chloride emulsion (gelatin/silver nitrate =1.67), hardened in the usual way with formaldehyde and containing the usual amounts of the developing agents 1-phenyl-3-pyrazolidone and hydroquinone, was coated at 35° C. on a polyethylene-covered paper support of 140 g per $m^2$ in such a way that an amount of silver chloride equivalent to 1.7 g of silver nitrate was present per $m^2$.

A name, address, and signature were projected on the resulting light-sensitive element.

A colour light-sensitive element, adapted for recording a continuous tone colour portrait and comprising developing agents was then made as follows.

A subbed water-resistant paper support consisting of a paper sheet of 110 g per $m^2$ coated on both sides with a polyethylene stratum of 15 g per $m^2$ was treated with a corona discharge and coated with the following layers in the order given:

(1) an alkali-permeable red-sensitized silver halide emulsion layer, after having been dried containing per m2:
- gelatin: 1.500 g
- cyan dye-providing quinonoid compound C having the structural formula given in Table 1 hereinafter: 0.265 g
- silver chloride (expressed as silver nitrate) (applied from a red-sensitized gelatin silver chloride emulsion): 0.500 g
- 2,5-bis(1',1',3',3'-tetramethylbutyl)-hydroquinone: 0.105 g (2) an intermediate layer containing per m2:
- gelatin: 1.300 g
- 2-Alpha-methyl-n-heptadecyl-5-sulphohydroquinone potassium salt: 0.115 g
- Pigment Red 146 (C.I. 11,000) as magenta filtering dye: 0.910 g (3) an alkali-permeable green-sensitized silver halide emulsion layer containing per m2:
- gelatin: 1.500 g
- magenta dye-providing quinonoid compound M having the structural formula given in Table 1 hereinafter: 0.232 g
- 2,5-bis(1',1',3',3'-tetramethylbutyl)-hydroquinone: 0.100 g
- silver chloride expressed as silver nitrate (applied from a green-sensitized gelatin-silver chloride emulsion): 0.500 g (4) an intemediate layer containing per m2:
- gelatin: 1.150 g
- 1-phenyl-4-methyl-3-pyrazolidinone: 0.080 g
- 2-Alpha-methyl-n-heptadecyl-5-sulphohydroquinone potassium salt: 0.120 g
- Pigment Yellow 83 (C.I. 20,000) as yellow filtering dye: 1.085 g (5) an alkali-permeable blue-sensitve silver halide emulsion layer containing per m2:
- gelatin: 1.100 g
- yellow dye-providing compound Y having the structural formula given in Table 1 hereinafter: 0.465 g
- silver chloride expressed as silver nitrate (applied from a blue-sensitive gelatin-silver chloride emulsion): 0.500 g (6) a protective layer containing per m2:
- gelatin: 1.400 g
- 1-phenyl-4-methyl-3-pyrazolidinone 0.150 g
- a sufficient amount of citric acid to adjust the pH of the whole layer packet to 4.5.

TABLE 1

Compound C

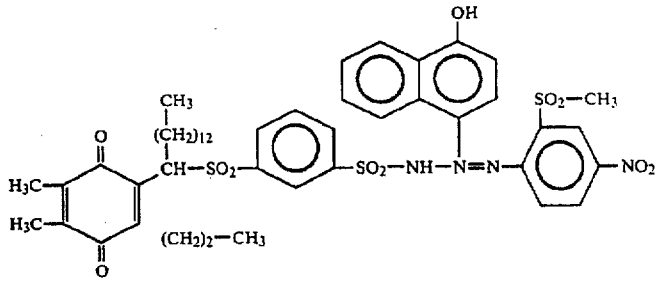

TABLE 1-continued

Compound M

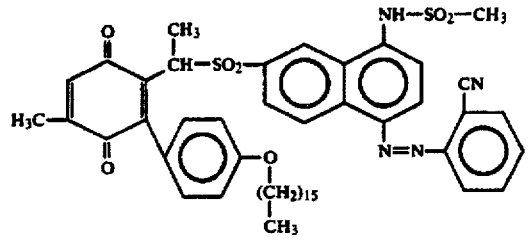

Compound Y

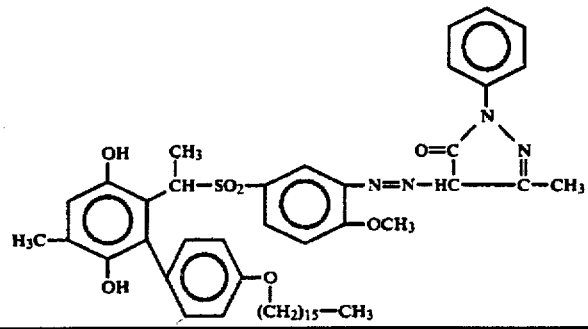

The resulting colour light-sensitive element was image-wise exposed to form a latent colour portrait therein.

Each of the image-wise exposed elements was moistened in an apparatus of the type described in the European Patent Application No. 85201679.9, which corresponds to the U.S. Ser. No. 916,176, now U.S. Pat. No. 4,708,450, with an aqueous alkaline solution having the following composition:

sodium hydroxide: 25 g
sodium orthophosphate: 25 g
cyclohexane dimethanol: 25 g
2,2'-methylpropylpropane diol: 25 g
N-ethylbenzene-pyridinium chloride: 0.5 g
sodium thiosulphate: 15 g
demineralized water to make: 1 l After 3 to 5 s the moistened light-sensitive element adapted for continuous tone or halftone data entered in contact with the image-receiving layer for receiving the textual image of the receptor sheet and the moistened colour element entered in contact with the image-receiving layer for receiving the dye image on the opposite side of the receptor sheet.

After completion of the diffusion transfer and image formation on both sides of the receptor sheet, both elements were separated therefrom, the receptor sheet then showing a textual print of the name, address, and signature on one side and a colour portrait on the opposite side.

The dry receptor was then placed between polyethylene terephthalate sheets having a thickness of 100 um and laminated thereto at a temperature of 120° C. in a common laminating device. The images contained in the thus obtained laminate were thereby protected efficiently against damage, dirt, and forgery. In this way an identification document comprising both a textual print and a colour portrait was obtained in a very convenient way requiring a reduced number of treating steps.

We claim:

1. A method of making a personal identification document exhibiting textual data and a portrait of the person, wherein said method comprises the steps of forming a monochrome photographic textual image in a monochrome photographic silver halide material, forming a colour photographic portrait image in a colour photographic silver halide material, producing from these images corresponding monochrome and coloured diffusion transfer images in image-receiving layers on opposite sides of a common receptor sheet, said receptor sheet bearing the resulting diffusion transfer images constituting a said personal identification document.

2. A method according to claim 1, wherein the compositions of the different photographic silver halide materials are such that an aqueous alkaline processing liquid of the same composition can be used for bringing about the diffusion transfer from both said materials and that an aqueous alkaline processing liquid of the same composition is in fact used for both diffusion transfer operations.

3. A method according to claim 2, wherein the developing agents needed for developing said different photographic silver halide materials have been incorporated into said photographic silver halide materials.

4. A method according to claim 3, wherein the developing agents needed for developing said different photographic silver halide materials have been incorporated into at least one silver halide emulsion layer thereof or in another layer in water-permeable relationship therewith.

5. A method according to claim 2, wherein the two diffusion transfer operations are performed at substantially the same time.

6. A method according to claim 1, wherein the image-receiving layers of the receptor sheet are carried by a polyvinyl chloride support and wherein following the production of the diffusion transfer images and drying of the receptor sheet it is sandwiched between layers of a polyethylene terephthalate resin film carrying a coating of polyethylene having a glass transition temperature at least 40° C. lower than that of the polyvinyl chloride and is laminated to such layers.

* * * * *